US008844757B2

(12) United States Patent
Wilmers et al.

(10) Patent No.: US 8,844,757 B2
(45) Date of Patent: Sep. 30, 2014

(54) PACKAGES FOR CONSUMABLE PRODUCTS AND METHODS OF USING SAME

(75) Inventors: Kimberly Ann Wilmers, Twin Lake, MI (US); Cynthia Lynn Wilcox, Newaygo, MI (US); Stephen Andrew Wurth, St. Louis, MO (US); Bethanie Lynn Skinner, Litchfield, IL (US); Gary William Etheridge, St. Louis, MO (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 13/518,479

(22) PCT Filed: Jul. 12, 2010

(86) PCT No.: PCT/US2010/041721

§ 371 (c)(1),
(2), (4) Date: Aug. 30, 2012

(87) PCT Pub. No.: WO2011/078890

PCT Pub. Date: Jun. 30, 2011

(65) Prior Publication Data

US 2012/0312823 A1 Dec. 13, 2012

Related U.S. Application Data

(60) Provisional application No. 61/289,564, filed on Dec. 23, 2009.

(51) Int. Cl.
*B65D 75/32* (2006.01)
*B65D 1/34* (2006.01)

(52) U.S. Cl.
CPC ..... *B65D 75/326* (2013.01); *B65D 1/34* (2013.01); *B65D 2207/00* (2013.01)
USPC ..... 220/608; 220/669

(58) Field of Classification Search
CPC ..... B65D 1/34; B65D 81/3813; A47G 21/04
USPC ..... 220/675, 669, 660, 608, 623
See application file for complete search history.

(56) References Cited

U.S. PATENT DOCUMENTS 184,814 A 11/1876 Adam
1,637,100 A 7/1927 Bothe (Continued)

FOREIGN PATENT DOCUMENTS

DE 9017215 12/1990
DE 9017215 4/1992

(Continued)

OTHER PUBLICATIONS

Translation of WO 93/15635 [Hornig et al], Aug. 19, 1993, pp. 1-4.*

(Continued)

*Primary Examiner* — Robert J Hicks
(74) *Attorney, Agent, or Firm* — Gary M. Lobel

(57) ABSTRACT

Packages for housing consumable products and methods of using same are provided. Methods for teaching children to self-feed are also provided. In a general embodiment, the present disclosure provides a package including a body defining side walls (34,36) a first end wall (40), an inclined second end wall (42) and an elongated interior compartment having a predetermined width for housing consumable products. In another embodiment, a package is provided that includes a body defining side walls, a bottom wall (38) a first end wall (40) oriented at 90° to the bottom wall, a second end wall (42) inclined at an angle with respect to the bottom wall (38), and an interior compartment for housing consumable products, the package being so constructed and arranged to stand substantially upright.

6 Claims, 1 Drawing Sheet

(56) References Cited

U.S. PATENT DOCUMENTS

| | | | | | |
|---|---|---|---|---|---|
| D75,723 | S | | 7/1928 | Engel | |
| D75,939 | S | | 7/1928 | Tennhardt | |
| 1,892,756 | A | | 1/1933 | Van Horne | |
| 1,974,898 | A | | 9/1934 | Rutledge | |
| 2,585,174 | A | | 2/1952 | Rosendahl | |
| 3,116,152 | A | * | 12/1963 | Smith | 426/115 |
| 3,407,969 | A | | 10/1968 | Klein | |
| 3,442,435 | A | * | 5/1969 | Huston et al. | 220/528 |
| 3,515,268 | A | | 6/1970 | Lindberg | |
| 3,739,939 | A | | 6/1973 | Koenig | |
| 3,765,595 | A | | 10/1973 | Bernhardt | |
| 4,102,468 | A | | 7/1978 | Goldman | |
| D249,218 | S | | 9/1978 | Mathison et al. | |
| 4,173,655 | A | | 11/1979 | Capo | |
| D264,791 | S | | 6/1982 | Conti | |
| D275,165 | S | | 8/1984 | Grusin | |
| 4,815,604 | A | | 3/1989 | O'Neil et al. | |
| 4,967,908 | A | | 11/1990 | Kessler | |
| 5,035,327 | A | | 7/1991 | Denzin | |
| D349,050 | S | | 7/1994 | Krupa | |
| 5,390,817 | A | | 2/1995 | Rosen | |
| 5,533,228 | A | | 7/1996 | Jarecki | |
| 5,676,276 | A | | 10/1997 | Zielinski | |
| D400,099 | S | | 10/1998 | Brauner et al. | |
| 5,839,609 | A | | 11/1998 | Zakensberg | |
| 5,878,908 | A | * | 3/1999 | Foley | 220/575 |
| D419,364 | S | | 1/2000 | Jarvis | |
| 6,065,600 | A | | 5/2000 | Chen | |
| 6,149,006 | A | | 11/2000 | Brauner et al. | |
| 6,367,649 | B1 | * | 4/2002 | Balakumar | 220/575 |
| 6,622,340 | B2 | | 9/2003 | Rosa | |
| 7,575,127 | B2 | | 8/2009 | Kishbaugh et al. | |
| D615,265 | S | | 5/2010 | Bergman | |
| D620,809 | S | * | 8/2010 | Caldwell et al. | D9/707 |
| D630,394 | S | | 1/2011 | Bergman | |
| 2002/0005409 | A1 | | 1/2002 | Rosa | |
| 2003/0015532 | A1 | | 1/2003 | Rickman et al. | |
| 2004/0140240 | A1 | | 7/2004 | Ricotti | |
| 2004/0144683 | A1 | | 7/2004 | Wang | |
| 2005/0006268 | A1 | | 1/2005 | Futernick | |
| 2005/0077303 | A1 | | 4/2005 | Minner et al. | |
| 2006/0124649 | A1 | | 6/2006 | Campbell | |
| 2009/0301923 | A1 | | 12/2009 | Van Puijenbroek | |
| 2010/0001007 | A1 | | 1/2010 | Ferraro | |
| 2011/0284119 | A1 | | 11/2011 | Andrews | |
| 2012/0103999 | A1 | | 5/2012 | Weidner et al. | |
| 2013/0153582 | A1 | | 6/2013 | Bollengier | |

FOREIGN PATENT DOCUMENTS

| | | |
|---|---|---|
| EP | 0223581 | 11/1986 |
| EP | 0223581 | 5/1987 |
| EP | 1942058 | 7/2008 |
| FR | 2695309 | 9/1992 |
| WO | 9315635 | 12/1992 |
| WO | 93/15635 | 8/1993 |
| WO | 0266337 | 2/2002 |
| WO | 02/066337 | 8/2002 |

OTHER PUBLICATIONS

International Search Report and Written Opinion from corresponding PCT Application No. PCT/US2010/041719 dated Oct. 26, 2010.

* cited by examiner

PACKAGES FOR CONSUMABLE PRODUCTS AND METHODS OF USING SAME

BACKGROUND

The present disclosure relates generally to packaging. More specifically, the present disclosure relates to containers for storing consumable products and methods of using same.

Packaging for consumable products come in a variety of sizes, shapes, materials and designs. These sizes, shapes, materials and designs generally differ, for example, for aesthetic reasons or marketing purposes. Although consumable product packaging may be provided to enhance aesthetic qualities or marketability of packages, the purposes for consumable product packaging are not limited to only these purposes.

Indeed, consumable product packages aimed at providing improved aesthetic qualities or marketability of a package may not always provide optimal functionality. Instead, consumable product packaging having specific shapes and sizes may provide functional advantages to a customer and/or user of such packages in addition to possible aesthetic and/or marketing advantages.

SUMMARY

The present disclosure provides packages for housing consumable products and methods of using same. In a general embodiment, a package includes a body defining side walls, a first end wall, an inclined second end wall and an elongated interior compartment for housing consumable products. The elongated interior compartment has a width that is about as wide as an average child's hand.

In an embodiment, the second end wall is inclined with respect to a bottom wall of the body at an angle from about 100° to about 170°. The second end wall may be inclined at an angle of about 135°.

In an embodiment, the first end wall is inclined at an angle with respect to a bottom wall.

In an embodiment, the first end wall is oriented at about 90° with respect to a bottom wall of the body.

In an embodiment, the elongated interior compartment has a length to width ratio from about 6:1 to about 2:1. The length to width ratio may also be about 3:1.

In an embodiment, the body further defines a gripping portion.

In an embodiment, package includes secondary packaging having indicia printed thereon.

In another embodiment, a package is provided. The package includes a body defining side walls, a first end wall, an inclined second end wall and an elongated interior compartment for housing consumable products. The elongated interior compartment has a width that is about as wide as an average eating utensil. The eating utensil may be selected from the group consisting of a spoon, a fork, or combinations thereof.

In an embodiment, the second end wall is inclined with respect to a bottom wall of the body at an angle from about 100° to about 170°. The second end wall may also be inclined at an angle of about 135°.

In an embodiment, the first end wall is inclined at an angle with respect to a bottom wall.

In an embodiment, the first end wall is oriented at about 90° with respect to a bottom wall of the body.

In an embodiment, the elongated interior compartment has a length to width ratio from about 6:1 to about 2:1. The length to width ratio may also be about 3:1.

In an embodiment, the body further defines a gripping portion.

In an embodiment, the package includes secondary packaging having indicia printed thereon.

In an embodiment, the average eating utensil is a spoon.

In yet another embodiment, a package is provided. The package includes a body defining side walls, a bottom wall, a top wall, first end wall oriented at 90° to the bottom wall, a second end wall inclined at an obtuse angle with respect to the bottom wall, and an interior compartment for housing consumable products. The interior compartment gradually tapers in width from the second end wall to the first end wall, and the package is so constructed and arranged to stand upright on at least a portion of first end wall.

In an embodiment, the second end wall is inclined with respect to the bottom wall at an angle from about 100° to about 170°. The second end wall may also be inclined at an angle of about 135°.

In an embodiment, the top wall includes a gripping portion.

In an embodiment, at least a portion of each side wall includes a gripping portion.

In an embodiment, the package includes secondary packaging having indicia printed thereon.

In still yet another embodiment, methods for teaching an individual to self-feed are provided. The methods include providing a package to a child having a body defining side walls, a first end wall, an inclined second end wall and an elongated interior compartment housing consumable products. The second end wall has a width that is about as wide as an average child's hand. The methods further include guiding a child's hand using the elongated interior compartment to teach the child to self-feed.

In another embodiment, methods for teaching a child to self-feed are provided. The methods include providing a package to a child having a body defining side walls, a first end wall, an inclined second end wall and an elongated interior compartment housing consumable products. The second end wall has a width that is about as wide as an average eating utensil. The methods further include providing an eating utensil to the child, and guiding the eating utensil using the elongated interior compartment to teach the child to self-feed.

In yet another embodiment, methods for teaching an individual to self-feed are provided. The methods include providing a package to a child having a body defining side walls, a bottom wall, a top wall, first end wall oriented at 90° to the bottom wall, a second end wall inclined at an obtuse angle with respect to the bottom wall, and an interior compartment housing consumable products. The interior compartment gradually tapers in width from the second end wall to the first end wall. The package is also so constructed and arranged to stand upright on at least a portion of first end wall. The methods further include using the inclined second end wall to scoop the consumable products for self-feeding.

In an embodiment, the consumable products may be scooped using the child's hand.

In still yet another embodiment, methods for marketing consumable products are provided. The methods include providing a package including a body defining side walls, a bottom wall, a top wall, first end wall oriented at 90° to the bottom wall, a second end wall inclined at an obtuse angle with respect to the bottom wall, and an interior compartment housing consumable products. The interior compartment gradually tapers in width from the second end wall to the first end wall, and the package is so constructed and arranged to stand upright on at least a portion of first end wall. The methods further include standing the package on a retail shelf in a substantially upright position such that the package stands on at least a portion of the first end wall.

It is an advantage of the present disclosure to provide an improved consumable product container.

It is also an advantage of the present disclosure to provide consumable product containers that are aesthetically pleasing to children.

It is another advantage of the present disclosure to provide consumable product containers that teach children to self-feed.

It is yet another advantage of the present disclosure to provide consumable product containers that provide improved marketability of the containers.

It is a further advantage of the present disclosure to provide consumable product containers that are easily gripped by caretakers for handling children's foods.

Yet another advantage of the present disclosure is to provide consumable product containers that are easily gripped by children for self-feeding.

Additional features and advantages are described herein, and will be apparent from, the following Detailed Description and the figures.

DETAILED DESCRIPTION

The present disclosure provides packages for housing consumable products and methods of using same. Methods for teaching individuals to self-feed are also provided. The individual may be a child or a cognitively impaired individual, for example. In a general embodiment, a package includes a body defining side walls, a first end wall, an inclined second end wall, and an elongated interior compartment for housing consumable products. The second end wall may be inclined with respect to a bottom wall of the body at an angle from about 100° to about 170°. The elongated interior compartment may have a certain width. In another general embodiment, a package includes a body defining side walls, a bottom wall, a first end wall oriented at 90° to the bottom wall, a second end wall inclined at an obtuse angle with respect to the bottom wall, and an interior compartment for housing consumable products. The interior compartment gradually tapers in width from the second end wall to the first end wall. The package may be so constructed and arranged to stand substantially upright.

As used herein, an "elongated" interior compartment shape means that a length of an interior compartment of the present packages is greater than a width of the interior compartment. For example, a length to width ratio of an interior compartment of the present disclosure may be from about 6:1 to about 1.5:1. In another embodiment, the length to width ratio of an interior compartment of the present disclosure may be from about 5:1 to about 2:1. In an embodiment, the length to width ratio of an interior compartment of the present disclosure is about 3:1. The skilled artisan will appreciate that, in an embodiment having an elongated interior compartment, the length to width ratio may be any length to width ratio that results in an elongated shape.

Packages of the present disclosure are designed to house consumable products. Consumable products housed in the packages may be any consumable products including, for example, baby foods, snack foods, full meals, side meals, etc. In an embodiment, the packages house foods for children (e.g., infants, toddlers, pre-schoolers, etc.) including, for example, fruits, vegetables, grains, cereals, pastas, etc. The consumable products may be finger foods or may be designed to be consumed using utensils. The teachings of the present disclosure, therefore, are not dependent upon the consumable products being of any particular type so long as the products fit within the packages described herein.

Figure 1:
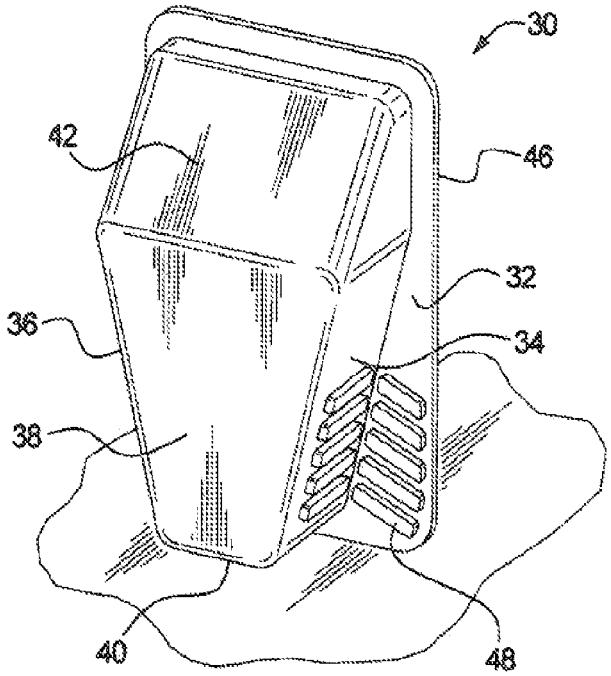
FIG. 1 illustrates a perspective view of a package in accordance with an embodiment of the present disclosure.
Figure 2:
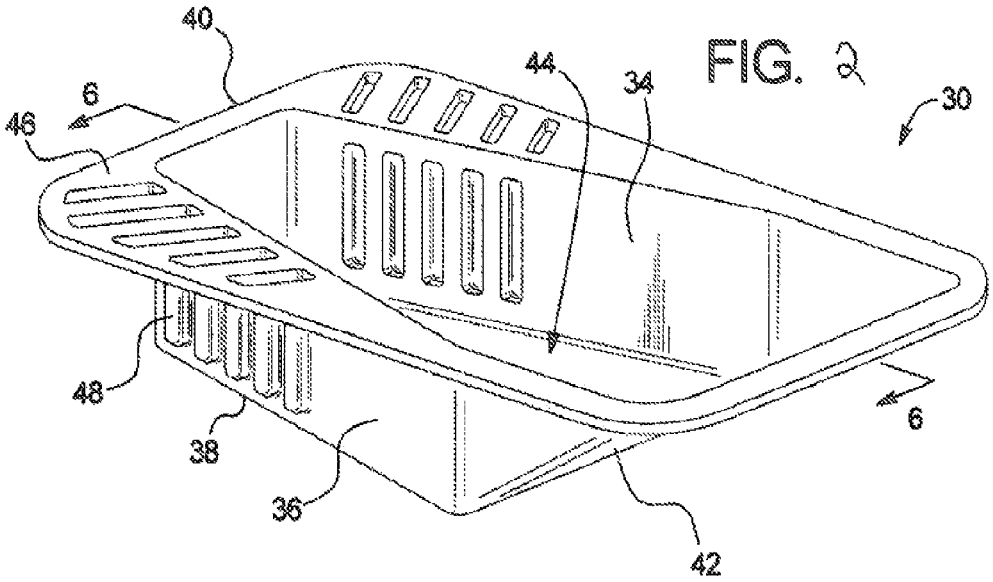
FIG. 2 illustrates a perspective view of a package in accordance with an embodiment of the present disclosure.
Figure 3:
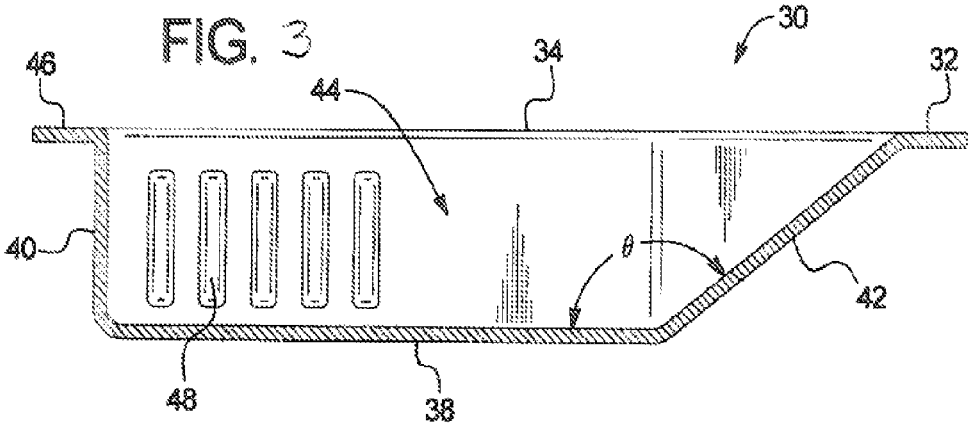
FIG. 3 illustrates a cross-sectional view of a package in accordance with an embodiment of the present disclosure and taken along line 6-6 in FIG. 3.

In an embodiment, as shown in FIGS. 1-3, a package 30 for storing consumable products is provided. Package 30 includes a body 32 defining side walls 34, 36, a bottom wall 38, and a first end wall 40 oriented at 90° to bottom wall 38. Package 30 also includes a second end wall 42 inclined at an obtuse angle with respect to bottom wall 38, and an interior compartment 44 for housing consumable products. The interior compartment 44 gradually tapers in width from second end wall 42 to first end wall 40. Body 32 further defines a top wall 46 and is so constructed and arranged to stand substantially upright.

Package 30 is not limited to any particular size or shape so long as consumable products may be contained in interior compartment 44 and package 30 may stand substantially upright on its own, as will be discussed further below. In an embodiment, package 30 houses consumable products designed for children (e.g., infants, toddlers, pre-schoolers), and should be sized accordingly. For example, package 30 should not be so large that a child is unable to easily hold package 30 by his or herself. This will aid in teaching a child to self-feed, as will be discussed further below.

Additionally, package 30 may be sized to be easily held by a caretaker or parent for preparing or administering a meal to a child. For example, package 30 may be about as wide as is comfortable for an average adult-sized hand. As will be discussed further below, this will allow the caretaker or parent to easily grasp package 30 for scooping food therefrom or for feeding a child.

Body 32 may have any shape including, for example, polygonal, semi-circular, oblong, or combinations thereof. In an embodiment, body 32 has a polygonal shape selected from the group consisting of rectangular, square, triangular, trapezoidal, or combinations thereof. Similarly, interior compartment 44 may have any shape including, for example, polygonal, semi-circular, oblong, or combinations thereof. In an embodiment, interior compartment 44 has a polygonal shape selected from the group consisting of rectangular, square, triangular, trapezoidal, or combinations thereof. In an embodiment, and as shown in FIGS. 2 and 3, body 32 has a substantially rectangular shape. The skilled artisan will appreciate, however, that neither body 32 nor interior compartment 44 are limited to any particular shape.

Side walls 34, 36 may be oriented at a substantially 90° angle to bottom wall 38. In another embodiment, first and second side walls 34, 36 slightly taper from a top wall 46 of package 40 to bottom wall 38.

In an embodiment, as shown in FIGS. 1-3, first end wall 40 may be oriented at about a 90° angle to bottom wall 38, while second end wall 42 may be substantially inclined so as to form a ramp. To form a ramp at second end wall 42 of package 30, second end wall 42 should be oriented at an obtuse angle, θ, with respect to bottom wall 38, as is shown in FIG. 3. In an embodiment, θ ranges from about 100° to about 170°. In another embodiment, θ ranges from about 120° to about 150°. In another embodiment, θ is about 135°.

In embodiments having an inclined second end wall 42, the inclined portion may be one straight inclined plane extending from bottom wall 38 to top wall 46. Alternatively, inclined second end wall 42 may be formed from a series of short inclined planes that form an inclined second end wall 42 (not shown). In embodiments formed from a series of short inclined planes, θ may be measured from a first inclined portion adjacent bottom wall 38.

Package 30, which includes first end wall 40 oriented at 90° with respect to bottom wall 38 and inclined second end wall 42, provides several advantages to consumers. For example, inclined second end wall 42 allows a child to self-feed by raking consumable products contained in interior compartment 44 up inclined second end wall 42. The child may be able to carry package 30 in one hand, or set package 30 on a supporting surface, an scoop up consumable products contained therein with the other hand. The inclined second end wall 42 forms a ramp that allows for easier raking of consumable products into the child's hand.

Additionally, in embodiments wherein package 30 is used in conjunction with eating utensils, inclined shape of second end wall 42 may allow for easier pouring or funneling of consumable products from package 30 into another container or onto a plate, for example. Inclined second end wall 42 may also provide a caretaker or parent of a child the benefits of more easily and efficiently serving food to a child, storing food in a container or cleaning up after a child's meal, among others.

In an embodiment, the width of interior compartment 44 tapers from inclined second end wall 42 to first end wall 40, as is shown in FIG. 2. The tapering of the width of interior compartment 44 is due to a tapering in width of bottom wall 38 from inclined second end wall 42 to first end wall 40. For example, as shown in FIG. 2, the width of interior compartment 44 at an end of package 30 near first end wall 40 may be narrow enough to be held comfortably in the hand of a small child, which will further aid a child in scooping or raking consumable products into the child's hand. In this manner, the child's hand will trap consumable products between bottom wall 38 and the child's hand such that the consumable products will readily move up inclined second end wall 42 and into the child's hand.

Package 30 may also include a lid (not illustrated) or other form of closure such as a removable closure to properly store the consumable products therein. For example, a lid may be made of cardboard, paperboard, lid stock, etc. Alternatively, a removable closure (not shown) such as, for example, a transparent film or a lid stock, may be sealed onto top wall 46 of body 32. Removable closure may be used alone or in conjunction with a lid and may be used to keep the products fresh and to extend the shelf life of the products. Any conventional sealing technique known in the art may be used to seal the removable closure onto top wall 46 of body 32. The techniques may include, but are not limited to, conductive heating, cold sealing, heat sealing, heat activated adhesive, etc.

Package 30 may be made from a molded plastic material such as for example, polyethylene, polypropylene, or the like, or combinations thereof. Body 32 may be formed using conventional thermoforming or molding processes including, but not limited to, injection molding, injection blow molding and extrusion blow molding. Alternatively, package 30 may be manufactured from non-plastic materials including, but not limited to, cardboard, metal, styrofoam, etc. Further, at least a portion of package 30 can be either transparent or translucent so that a consumer can readily discern what types of products are housed in interior compartment 44 of package 30. Alternatively, at least a portion of package 30 may be opaque. In an embodiment wherein a lid (not illustrated) is provided, the lid may be translucent while body 32 is opaque.

In addition to having different optical properties, package 30 may also have different colors. Package 30 may have a color selected from the group consisting of white, yellow, orange, red, green, blue, purple, brown, black, etc. For example, in an embodiment, package 30 may be transparent and red in color. Alternatively, package 30 may be opaque and blue in colors. The skilled artisan will appreciate that the optical properties and colors of package 30 are not limiting and that package 30 may have any combination thereof.

Package 30 may include indicia (not illustrated) provided on an exterior and/or interior of body 32 for marketing purposes. The indicia may include, for example, logos, advertisements, branding information, nutritional information, product information, manufacturer information, etc. The indicia may be printed on a pressure sensitive material, printed directly on package 30, printed on a removable closure, etc.

For marketing purposes, package 30 may be provided with secondary packaging (not illustrated) to aid in standing package 30 substantially upright on first end wall 40. However, due to the configuration of package 30, such secondary packaging is not necessary for package 30 to stand substantially upright on, for example, a retail shelf. Providing package 30 that is able to stand substantially upright without secondary packaging provides several advantages. For example, by reducing the amount of packaging, manufacturers are able to reduce the costs of manufacturing package 30, as well as the amount of packaging waste that is discarded by a consumer.

As shown in FIG. 1, first end wall 40 in combination with a portion of top wall 46 define a plane on which package 30 may stand. In this manner, as long as package 30 defines a plane (i.e., at least three points of contact) on which package 30 can rest, the shape of body 32 and interior compartment 44 is immaterial. In an embodiment, package 30 may rest in a substantially vertical or upright position or may rest in a position that tilts toward or away from a consumer, depending on the shape of package 30. Regardless of the shape of package 30, if intended to stand substantially upright, package 30 must be able to stand in a stable manner on the plane. In other words, package 30 must be so constructed and arranged so that it will not easily fall over when filled with consumable products.

In addition to standing substantially upright, package 30 may also be configured to lay substantially flat on top wall 46 of body 32 or bottom wall 38. Alternatively, package 30 may be provided with a hook portion (not illustrated) of body 32 that is configured to receive a hanger that allows package 30 to be hung from a retail display in a retail store.

Packages of the present disclosure may further include bodies having a gripping portion. The gripping portion of the bodies may be any portion of the body that aids a consumer in handling the packages. For example, the gripping portion of a body may be any gripping portion that allows a child to handle the packages on his or her own so that the child may learn to self-feed. Alternatively, the gripping portion may be especially useful in embodiments where a caretaker/parent may need to quickly or steadily grasp the package for feeding a child, storing the consumable products in another container or cleaning up after a meal.

In an embodiment, for example, gripping portion 48 of FIGS. 1-3 define ridges formed in body 32 that allow for easier handling of package 30. While gripping portion 48 is illustrated as ridges formed in body 32 of FIGS. 1-3, the skilled artisan will appreciate that gripping portion 48 need not be ridges and may be any other gripping means known in the art. For example, in another embodiment, gripping portion 48 may include a texturized, roughened or raised area (not illustrated) of a surface of body 32.

Similarly, while gripping portion 48 of FIGS. 1-3 is illustrated as ridges formed in top wall 46 of body 32 and side walls 34, 36 of body 32, the skilled artisan will appreciate that gripping portion 48 need not be located on top wall 46 and/or side walls 34, 36. For example, in an embodiment, gripping portion 48 is located only on top wall 46. In another embodiment, gripping portion 48 is located only on side walls 34, 36. In yet another embodiment, bottom wall 38 may also include gripping portion 48. In other words, the skilled artisan will appreciate that gripping portion 48 may be located at any place on body 32 that will provide improved gripping of package 30.

In an embodiment, methods for using packages of the present disclosure are also provided. For example, in an embodiment, methods for teaching a child to self-feed are provided. The methods include providing a package to a child having a body defining side walls, a first end wall, an inclined second end wall and an elongated interior compartment housing consumable products. The second end wall has a width that is about as wide as an average child's hand. The methods further include guiding a child's hand using the elongated interior compartment to teach the child to self-feed.

In another embodiment, methods for teaching a child to self-feed are provided. The methods include providing a package to a child having a body defining side walls, a first end wall, an inclined second end wall and an elongated interior compartment housing consumable products. The second end wall has a width that is about as wide as an average eating utensil. The methods further include providing an eating utensil to the child, and guiding the eating utensil using the elongated interior compartment to teach the child to self-feed.

In yet another embodiment, methods for teaching an individual to self-feed are provided. The methods include providing a package to a child having a body defining side walls, a bottom wall, a top wall, first end wall oriented at 90° to the bottom wall, a second end wall inclined at an obtuse angle with respect to the bottom wall, and an interior compartment housing consumable products. The interior compartment gradually tapers in width from the second end wall to the first end wall. The package is also so constructed and arranged to stand upright on at least a portion of first end wall. The methods further include using the inclined second end wall to scoop the consumable products for self-feeding. The consumable products may be scooped using the child's hand.

In still yet another embodiment, methods for marketing consumable products are provided. The methods include providing a package including a body defining side walls, a bottom wall, a top wall, first end wall oriented at 90° to the bottom wall, a second end wall inclined at an obtuse angle with respect to the bottom wall, and an interior compartment housing consumable products. The interior compartment gradually tapers in width from the second end wall to the first end wall, and the package is so constructed and arranged to stand upright on at least a portion of first end wall. The methods further include standing the package on a retail shelf in a substantially upright position such that the package stands on at least a portion of the first end wall.

Providing uniquely designed packaging of the present disclosure advantageously aids in teaching children how to self-feed using an inclined end wall of a package. Additionally, an elongated shape of in interior compartment may serve as a guide means to guide either an eating utensil used by a child, or a hand of a child, for scooping up consumable products contained in the package. Additionally, the packages of the present disclosure also provide improved marketability of consumable product packaging.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A package comprising:

a body having a bottom wall, a pair of side walls, a first end wall oriented at 90° to the bottom wall, and a second end wall inclined at an obtuse angle with respect to the bottom wall, the bottom wall, the pair of side walls, the first end wall, and the second end wall cooperating to define an interior compartment for housing consumable products, the interior compartment being elongated from the first end wall to the second end wall, each of the side walls having a first portion extending from the second end wall and a second portion extending between the first portion and the first end wall, the first portion of each of the side walls being oriented in a parallel relationship to one another, the second portion extending at an angle to the first portion in a way that the interior compartment tapers in width toward the first end wall.

2. The package of claim 1, wherein the second end wall is inclined with respect to the bottom wall at an angle from about 100° to about 170°.

3. The package of claim 1, wherein the second end wall is inclined with respect to the bottom wall at an angle of about 135°.

4. The package of claim 1, wherein the body further has a top wall extending outwardly from the side walls, the first end wall, and the second end wall in a parallel relationship to the bottom wall and wherein the top wall has a peripheral edge with first pair of sides parallel to the second portion of the side walls and a second pair of sides parallel to the first end wall.

5. The package of claim 1, wherein the first portion of each side wall comprises a gripping portion.

6. The package of claim 1, further comprising secondary packaging having indicia printed thereon.

* * * * *